United States Patent [19]

Buckenauer

[11] Patent Number: 4,781,489

[45] Date of Patent: Nov. 1, 1988

[54] ASSEMBLY FOR BRIDGING OVER EXPANSION JOINTS

[75] Inventor: Guenter Buckenauer, Baldham, Fed. Rep. of Germany

[73] Assignee: Friedrih Maurer Sohne GmbH & Co., Munich, Fed. Rep. of Germany

[21] Appl. No.: 115,571

[22] Filed: Jun. 11, 1987

Related U.S. Application Data

[63] Continuation of Ser. No. 835,903, Mar. 4, 1986, abandoned.

[30] Foreign Application Priority Data

Mar. 6, 1985 [DE] Fed. Rep. of Germany ..... 3508010

[51] Int. Cl.[4] ..... E01C 11/12

[52] U.S. Cl. ..... 404/65; 404/68; 52/396; 52/403

[58] Field of Search ..... 52/393, 396, 403; 404/47, 48, 64–69, 74, 87

[56] References Cited

U.S. PATENT DOCUMENTS

| | | | |
|---|---|---|---|
| 3,363,383 | 1/1968 | Barge | 404/65 X |
| 3,608,442 | 9/1971 | Berchou et al. | 404/65 |
| 3,824,025 | 7/1974 | Beutler | 404/68 X |
| 4,007,994 | 2/1977 | Brown | 52/396 X |
| 4,423,979 | 1/1984 | Brown | 52/396 X |
| 4,537,003 | 8/1985 | Huber et al. | 52/396 X |
| 4,685,825 | 8/1987 | Buckenauer | 404/65 |

*Primary Examiner*—Carl D. Friedman
*Assistant Examiner*—Richard E. Chilcot, Jr.
*Attorney, Agent, or Firm*—Kline, Rommel & Colbert

[57] ABSTRACT

The assembly for bridging over expansion joints comprises sealing band of elastic material which bridges over the joint, which sealing band, for being secured in upward open cavities, includes thickenings substantially filling up said cavities and extending in joint edge profiles at both sides in the longitudinal direction of the profile. Said thickenings include a support surface engaging in the inserted position with an appropriate pressing surface of the joint edge profile, said thickening being wedged in the cavity by means of a bulge formed thereon. Said thickening includes a nose formed thereon, which in the inserted position is pressed together in a manner that in the marginal portions of the cavity between the thickening and the joint edge profile there is a contact pressure. Thus it can be avoided that under the effect of any forces there opens a slit between the sealing band and the joint edge profile, whereinto moisture or dirt may make their way.

5 Claims, 2 Drawing Sheets

ASSEMBLY FOR BRIDGING OVER EXPANSION JOINTS

This application is a continuation of application Ser. No. 835,903 filed 3/4/86, now abandoned.

BACKGROUND OF THE INVENTION

The invention relates to an assembly for bridging over expansion joints, particularly in bridges, parts of roadways or the like, by a sealing band of elastic material which bridges over the joint, which sealing band, for being secured in upward open cavities, includes thickenings substantially filling up said cavities and extending from joint edge profiles arranged on the joint edges to the opposite sides in the longitudinal direction of the profile, which thickenings include a support surface engaging in the inserted position with an appropriate inner surface of the cavity.

Such an assembly is disclosed in the West German Pat. No. 2,808,386. This known assembly comprises a non-trafficable sealing profile strip and therefore may be used only for very narrow joints, so that when it is exposed to increased tensile load or to a single sided vertical thrust, a split may open between the joint edge profile and the sealing band received therein, and moisture and dirt may penetrate into said split. In the long run this will damage the sealing band, and also the joint edge profile may be impaired due to corrosion.

Also in the bridging assembly disclosed in West German Pat. No. 3,131,804 and comprising a trafficable sealing profile strip, the penetration of moisture and dirt into the cavity of the joint edge is not absolutely excluded.

SHORT OUTLINE OF THE INVENTION

It is the object of this invention to improve an assembly for bridging over expansion joints as described above in a way that even in case of considerable tensile loads and single sided vertical thrusts it can be safely excluded that dirt and moisture make their way into the cavity of the joint edge, thus extending the useful life of this assembly to a considerable extent.

According to the present invention this object is achieved by an assembly wherein each thickening comprises at least one projecting nose which in the inserted position is pressed together by a corresponding portion of the inner wall of the cavity, so that in the area of the edge portions of the cavity there is produced a contact pressure between the thickening and the corresponding portions of the inner walls of the joint edge profile.

In the joint bridging assembly according to the present invention not only the thickening designed at each of the two sides of the sealing band is wedged in the cavity of the joint edge so as to safely secure the sealing band in the joint edges, but in the marginal areas of the cavity there is also created a prestressing inside the sealing band adjoining said cavity. For this purpose a projecting nose, which is formed on the thickening of the sealing band, is pressed together when being in the inserted position, so that a contact pressure is caused which prevents the sealing band from getting detached from the inner wall of the cavity in the area of the marginal portions. By selecting a suitable inclination of the nose to be pressed together it will be possible to determine the prestressing in such a way that the traction forces acting along the direction of the joints and the vertical forces acting perpendicularly thereto are smaller than the prestressing of the sealing band arranged in the cavity.

Suitably the projecting nose is arranged in an area which is adjacent to a marginal portion of the cavity. This ensures the desired contact pressure at both marginal portions of the cavity so that it will be absolutely excluded that dirt and moisture make their way into the cavity.

It is another advantage of the invention that the joint edge profile which forms the respective cavity comprises a synclinal depression having a substantially horizontal marginal portion and a substantially vertical marginal portion. According to the invention the horizontal marginal portion extends at about half of the level of the depression towards the joint, while the vertical marginal portion extends up to the level of the roadway surface on the side which is averted from the joint. Thus, the thickening pressed into the cavity of such a joint edge profile is on the one hand adjacent to the vertical marginal portion of the cavity where it is exposed to a prestressing and on the other hand it is fully supported on the horizontal marginal portion so as to form a constantly supporting bearing for the sealing band.

According to another proposal of the invention the vertical marginal portion may be an inwardly flanged edge of the joint edge profile, whose lower horizontal edge engages from the rear side with the support surface of the thickening. As the thickening of the sealing band is pressed into the cavity obliquely from the top to the bottom, this particularly simple arrangement of the inner surface of the cavity, adjacent to the support surface, ensures a reliable wedging in of the sealing band, and the thickening may easily be inserted into the cavity.

According to the invention it may further be provided that the projecting nose may be arranged in the area of the thickening which in the inserted position adjoins the vertical marginal portion of the joint edge profile. Due to the nose pressed together in the inserted position the penetration of dirt and moisture in this particularly endangered area is prevented even in those cases when the joints are expanded and traction forces occur within the sealing band. At the same time there is created a contact pressure of the thickening against the horizontal marginal portion of the joint edge profile, so that when the joints are narrow, the thickening cannot bulge and the sealing band cannot be detached from the horizontal marginal portion.

According to the invention it may further be provided that the support surface of the thickening is downward inclined, extending to the side which is averted from the joint, i.e. to the periphery of the sealing band. The edge of the joint edge profile is inclined correspondingly to the support surface of the thickening so that when the thickening is in the inserted position there is created a contact pressure also in the area of the support surface, said contact pressure ensuring a tight sealing in this area. It is advantageous that in the area of the support surface the thickening comprises a hollow space which is formed either by a hollow chamber or by a continuous hole, enabling the projection adjacent to the support surface to yield towards this hollow space when the sealing band is inserted into the joint edge profile. Suitably the thickening is wider than the cross-section of the joint edge profile so that the sealing band is held in the joint edge profile due to the thickening and the effect of the prestressing. In the relaxed condition the projecting nose suitably extends substantially in an acute angle to the corresponding wall section so as to achieve a largely even distribution of the prestressing.

According to another proposal of the invention the thickening, when in the inserted position, comprises a substantially horizontal portion which is supported on the horizontal marginal portion of the joint edge profile. Such an arrangement provides for a large-surface-bearing of the sealing band, which bearing is constantly supporting due to the prestressing. As a consequence the sealing band may for a long time withstand the traffic load acting thereupon, and its useful life can be considerably extended. When it is in the inserted position, the upper surface of the thickening is flush with the roadway surface. Such an arrangement which does not provide any clearances between the edge of the joint and the surface of the sealing band, prevents water and dirt from being accumulated in this area.

According to another proposal of the invention the sealing band is made as a hollow profile which is formed by rhombically extending ribs. In order to prevent the upper edge of the hollow profile from bulging when the joint is narrow, the lower side of the hollow profile is generally V-shaped. At its upper side the hollow profile has advantageous V-shaped hollow spaces between the rhombically extending ribs, whose top edges are flush with the inserted thickening and the roadway surface. Due to the diagonally extending ribs the hollow profile of the sealing band introduced between the joint edges is stabilized in such a manner that the top surface of the sealing band adjoining to the traffic surface is completely plane in whatever condition the joint may be, i.e. also when the joint is narrow. Should any water or dirt accumulate in the V-shaped hollow spaces of the upper side of the hollow profile, this will in no way impair the useful life of the sealing band. Generally speaking, under the circumstances occuring in practice, the assembly according to the invention provides a completely tight connection of the sealing band to the joint edges, so that no moisture or dirt may penetrate, and the joint band is prevented from being vertically detached from the joint edge profile, which results in a longer useful life of the sealing band and in a better protection of the joint edge profile from corrosion.

Further features, advantages and details of the invention will be seen from the following description of one working example thereof using the drawings.

LIST OF DIFFERENT VIEWS OF THE DRAWINGS

DETAILED ACCOUNT OF A WORKING EXAMPLE OF THE INVENTION

Figure 1:
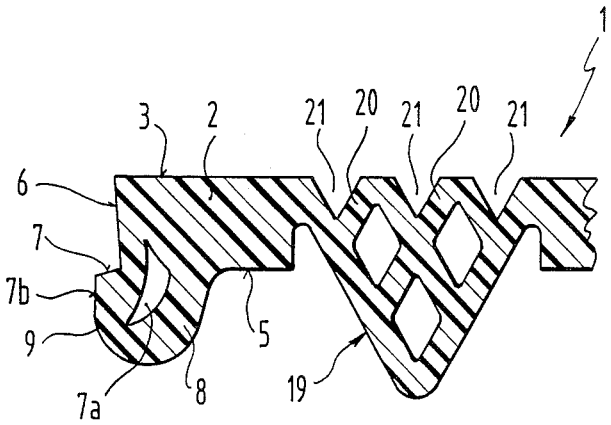
FIG. 1 is a cross-section through the lateral thickening of the sealing band in the relaxed state.

FIG. 1 shows, in the non-inserted position, one of the two lateral thickenings 2 of a sealing band 1 which preferably consists of a rubber-like material. The thickening 2 has a plane upper surface 3 which, when the sealing band 1 is in the inserted position, is flush with the roadway surface 4 (FIGS. 2 and 4), and a lower seating surface 5 which forms a bearing for the thickening. The thickening 2 further comprises a nose 6 which is pressed together when the sealing band is in the inserted position, so that said nose then extends substantially vertically and horizontally respectively. At its bottom portion the thickening changes over into a stem 8 which in turn ends in a bulge 9.

Figure 3:
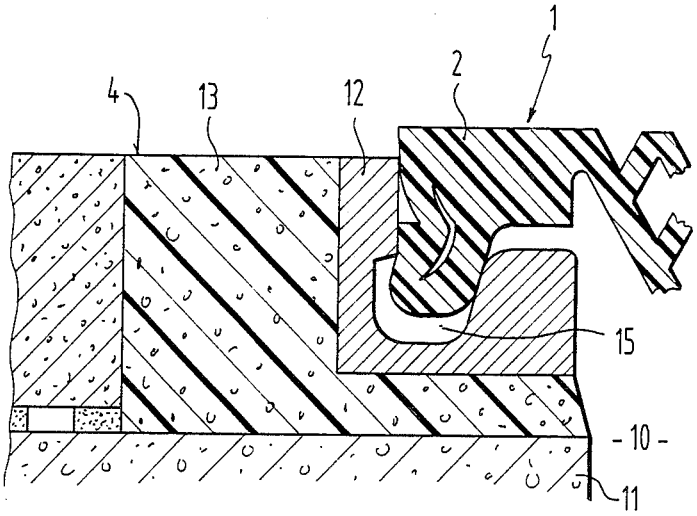
FIG. 3 shows the deformation of the sealing band when it is inserted into the joint edge profile.
Figure 4:
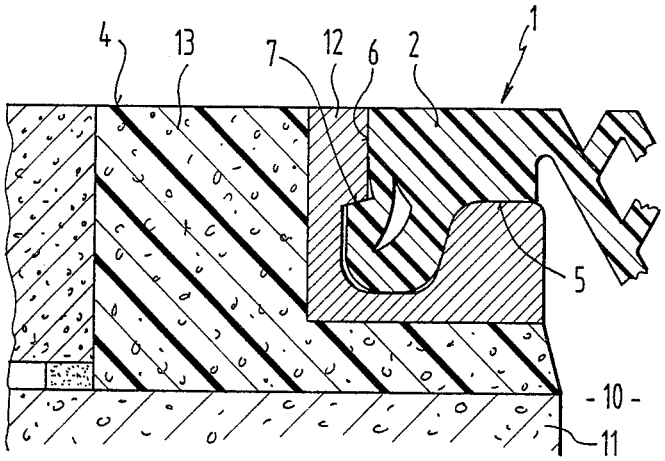
FIG. 4 shows a cross-section through a joint with the sealing band completely inserted in joint edges.

At half of the level of its left hand edge (FIG. 1) the thickening 2 has a projection *7b* adjoining the support surface 7, which projection is inclined to the outer side and adjoins the lower edge 18 (FIG. 2) when the sealing band is in the inserted position (FIG. 4). In this area there is also a hollow space *7a* which enables the projection *7b* to be pressed inside towards the hollow space when the thickening 2 is inserted into the joint edge profile 12 (FIG. 3).

Figure 2:
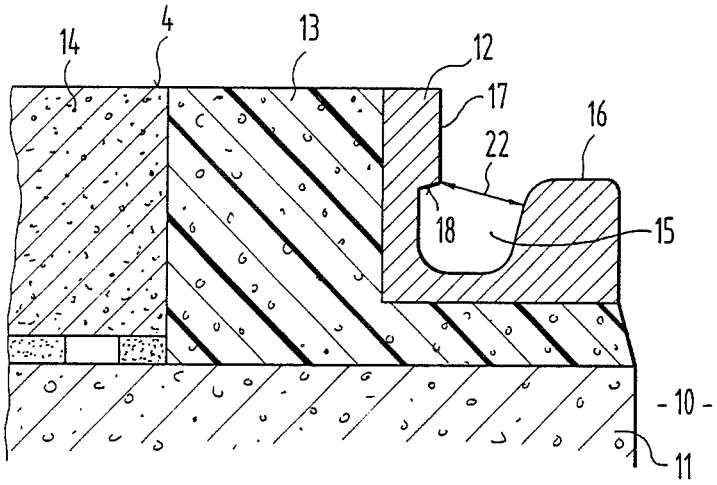
FIG. 2 is a cross-section through a joint without sealing band.

FIG. 2 shows a cross-section through a joint with a concrete substructure 11 adjoining the joint 10. The joint edge profile 12 is embedded in a plastic concrete bed 13 which is followed by the street asphalt 14.

The joint edge profiles 12 have a substantially synclinal cavity 15. At about half of the level of the joint edge profile 12 extends a horizontal marginal portion 16 in the direction of the joint 10. At the edge of the joint edge profile 12 there is arranged a vertical marginal portion 17 which extends up to the roadway surface 4.

FIG. 3 shows how the sealing band 1 with the thickening 2 is inserted into the joint edge profile 12. In this operation the projection *7b*, which adjoins the support surface 7, is pressed inside towards the hollow space *7a* so that the thickening 2 may be inserted through the reduced cross-section 22 into the synclinal cavity 15.

FIG. 4 shows the completely inserted sealing band, the upper sides of the lateral thickenings 2 being flush with the roadway surface 4. The nose 6 is pressed together and adjoins the vertical marginal portion 17. At the same time, the projection *7b* adjoins the edge 18, said projection *7b* forming a support surface of the thickening 2 in the cavity. The stem 8 with the bulge 9 is bent upward towards the joint so that somewhat above the support surface *7a* the bulge 9 adjoins a portion of the inner wall of the joint edge profile 12 and the thickening 2, and the thickening 2 is in a wedged condition in the cavity 15. The horizontal seating surface 5 of the thickening 2 rests, under the effect of a prestressing, on the horizontal marginal portion 16 of of the joint edge profile 12 so that the thickening is supported on the whole by three seating surfaces 5, 6, and 7 which are pressed against the inner wall of the cavity 15. This arrangement ensures that the sealing band is safely held in the joint edge profile, without forming any slits.

In the area of the joint 10 the sealing band 1 is made as a hollow profile 19. This hollow profile consists of rhombically extending ribs 20, and at the upper side of the hollow profile 19 the single rhombuses are flush with the inserted thickening 2 and the roadway surface 4. Between the rhombuses the upper side of the hollow profile includes V-shaped hollow spaces 21. At the bottom side the hollow profile 19 is on the whole V-shaped.

Due to the diagonally extending ribs 20 the vertical forces may be perfectly transmitted to the joint edges. Thanks to its particular design the hollow profile is stabilized in a manner that its upper surface is totally flush with the roadway surface even when the joint is in a narrow condition.

I claim:

1. In an assembly for bridging over an expansion joint of a load receiving surface of bridges, roadways and the like, and which includes two spaced apart complementary joint edge profiles facing each other and a sealing band interconnected to said joint edge profiles and bridging therebetween and across the expansion joint, each said joint edge profiles having an upper surface substantially coextensive with the load receiving surface and comprising an upwardly opening cavity having the cross-section of a synclinal depression, an elongated horizontal marginal portion extending from one side of said cavity and toward the other of said joint profiles and being disposed at a given level below the load receiving surface, and an end marginal portion extending from said cavity at the opposite side thereof from said horizontal marginal portion, said end marginal portion including a vertical marginal portion extending from the load receiving surface and toward said cavity, and a lower edge portion, said lower edge portion adjoining and extending from said cavity and being inclined to face inwardly of said cavity and being coextensive therefrom and joining said vertical marginal portion at a level of said vertical marginal portion below the load receiving surface, a substantial reach of said lower edge portion extending inwardly toward said cavity below the level at which said horizontal marginal portion is disposed with respect thereto, said sealing band being comprised of elastic material and including a body portion having an upper surface disposed to be positioned substantially flush to the load bearing surface, a medial portion, and opposite end portions which comprise lateral thickenings for interconnection of said sealing band to and between said joint edge profiles, each said lateral thickenings comprising a bulge for engaging within and substantially filling said cavity of one said joint edge profiles and having an inclined support surface disposed for mating abutment with said lower edge portion of said end marginal portion of such said one said joint edge profiles and which further comprises a seating surface for resting upon and in abutment with and along said horizontal marginal portion of such said one said joint edge profiles and a projecting nose portion adjoining said vertical marginal portion of such said one said joint edge profiles and extending therealong to the upper surface of said sealing band, said bulge being configured so that at least that portion of said nose portion adjacent the upper surface of said sealing band mates in compressed interfitting and sealing relationship with said vertical marginal portion of such said one said joint edge profiles.

2. An assembly as specified in claim 1 wherein said lower edge portion of each said joint edge profiles are disposed to extend inwardly toward said cavity at a level which is below the level at which said horizontal portion is disposed with respect thereto.

3. An assembly as specified in claim 1 wherein said horizontal marginal portion of each said joint edge profiles is disposed substantially midway between the lowermost reach of said cavity and said upper surface thereof.

4. An assembly as specified in either of claims 2 or 3 and wherein said medial portion of said sealing band comprises a plurality of ribs diagonally extending between said upper surface thereof and said lateral thickenings thereof whereby the thrust of vertical forces as exerted on said upper surface thereof are directionally transmitted to said joint edge profiles to which said sealing band is interconnected.

5. An assembly as specified in claim 3 wherein said ribs extend in rhombical relation.

* * * * *